United States Patent [19]

Peters

[11] 4,073,739

[45] Feb. 14, 1978

[54] TONER POWDER FOR ELECTROSTATIC IMAGES COMPRISING EPOXY RESIN

[75] Inventor: Martinus T. J. Peters, Venlo, Netherlands

[73] Assignee: Oce-van der Grinten, N.V., Venlo, Netherlands

[21] Appl. No.: 634,777

[22] Filed: Nov. 24, 1975

[30] Foreign Application Priority Data

Nov. 25, 1974 Netherlands ..... 7415325

[51] Int. Cl.[2] ..... G03G 9/08

[52] U.S. Cl. ..... 252/62.1 P; 8/4; 8/83; 96/1 SD; 96/1.2; 260/37 EP

[58] Field of Search ..... 252/621 P; 8/4, 83, 8/85 R, 85 B, 86, 89, 92; 96/1 SD, 1.2; 260/37 EP

[56] References Cited

U.S. PATENT DOCUMENTS

| | | | |
|---|---|---|---|
| 3,506,469 | 4/1970 | Titow | 252/62.1 P |
| 3,577,345 | 5/1971 | Jacknow et al. | 252/62.1 P |
| 3,609,082 | 9/1971 | Moriconi et al. | 252/62.1 P |
| 3,687,879 | 8/1972 | Vasta | 260/37 EP |
| 3,740,334 | 6/1973 | Jacknow et al. | 252/62.1 P |
| 3,753,910 | 8/1973 | Mitsuhashi et al. | 252/62.1 P |
| 3,817,868 | 6/1974 | Besaun et al. | 252/62.1 P |
| 3,893,934 | 7/1975 | Braun et al. | 252/62.1 P |

OTHER PUBLICATIONS

Lee et al., "Handbook of Epoxy Resins", McGraw-Hill, c. 1967.

*Primary Examiner*—Mayer Weinblatt
*Assistant Examiner*—John D. Smith
*Attorney, Agent, or Firm*—Albert C. Johnston

[57] ABSTRACT

Toner powders for developing electrostatic images are provided which contain in epoxy resin organic dye that, although in itself insoluble in the resin, is solubilized therein by one or more substances selected from the group consisting of complete esters and alkyl and aryl amides of o- and m-phthalic acid, carbonic acid, phosphoric acid, benzoic acid and benzenesulfonic acids and condensation products of formaldehyde with alkyl and aryl amides of benzenesulfonic acids.

9 Claims, No Drawings

TONER POWDER FOR ELECTROSTATIC IMAGES COMPRISING EPOXY RESIN

This invention relates to toner powder for use in the development of electrostatic images and, more particularly, to such powder the individual particles of which comprise epoxy resin and one or more organic dyes which in themselves are insoluble in the epoxy resin.

So-called two-component powder developers are widely used for the development of electrostatic images such as those formed on an insulating or photoconductive insulating surface in the electrographic and electrophotographic imaging arts. These powder developers comprise a mixture of fine, colored or black toner particles and comparatively coarse carrier particles. In use, the toner particles are charged triboelectrically by rubbing against the carrier particles, causing them to adhere electrostatically to the carrier particles. The composition of the developer components is chosen so that the toner particles thus acquire an electrostatic charge of a polarity opposite to that of the electrostatic image to be developed. As a result, when the developer is brought into contact with the electrostatic image, the toner particles are attracted from the carrier particles and deposited onto the electrostatic image by the electrostatic charge of the image. The powder image thus obtained is then fixed either on the surface bearing the charge or after being first transferred to a receiving surface.

The carrier particles contained in two-component powder developers may be powdered materials having any of a wide variety of compositions. The carrier particles may be composed, for instance, of metal, for example iron or nickel; or of metallic oxide, for example chromium oxide or aluminum oxide; or of glass, sand or quartz. Metal carrier particles, particularly iron particles, are frequently used, especially in the powder developers employed for so-called magnetic brush development in which the developer is carried by magnetic transport means to the electrostatic image to be developed.

The toner particles in the two-component powder developers mainly are composed of an insulating, thermoplastic resin, or of a mixture of such resins, and one or more coloring materials. Well-known natural and synthetic polymers are commonly used as the thermoplastic resin. Examples of the thermoplastic resins extensively used are polystyrene, copolymers of styrene with an acrylate and/or methacrylate, phenolformaldehyde resins, modified phenolformaldehyde resins, polyamides, polyester resins and epoxy resins. The coloring material used mostly in black toner powders is carbon black, while organic dyes that dissolve in the thermoplastic resin are used in colored toner powders as employed, for instance, in electrographic multicolor reproduction processes.

Besides thermoplastic resin and one or more coloring materials, the toner powders often contain a so-called polarity control agent for causing the toner particles to accept a charge of the desired polarity upon triboelectric contact with the carrier particles. The use of a polarity control agent is necessary particularly in toner powders used in combination with metal carrier particles, for example iron or nickel particles, for the development of negative electrostatic images, because in that case the toner particles are to be charged positively yet, without a polarity control agent, triboelectric contact with metal carrier particles causes the thermoplastic resins usually employed in toner particles to accept a negative charge. Organic dyes, in particular basic dyes and their salts such as the hydrochlorides, have proved effective as polarity control agents. Examples of polarity controlling dyes include nigrosine base, nigrosine hydrochloride, Safranine T, Neutral Red, Janus Blue, Nile Blue, Victoria Blue and Crystal Violet. Especially nigrosine base and nigrosine hydrochloride are frequently used as a polarity control agent.

To obtain a uniform charging of the toner particles, the polarity control agent must be distributed as homogeneously as practicable over the surface of the toner particles. Therefore, it is important to use polarity control agents which will dissolve in the thermoplastic resin from which the toner particles are formed.

Many of the organic dyes which would qualify for use as the polarity control agent and/or coloring material in toner powders have the drawback of being insoluble or insufficiently soluble in thermoplastic resin.

It has been proposed to improve the solubility of basic dyes in the thermoplastic resins frequently used in toner powders by employing the dyes in the form of their salt with an acid having a heavy hydrocarbon group, for example stearic acid, palmitic acid, dioctyl sulpho-succinic acid, dodecyl hydrogen sulphate, 2,4-ditertiary pentylphenoxyacetic acid and nonylnaphthalene sulphonic acid. See German Pat. No. 1,929,851 and Belgian Pat. No. 806,408. The preparation of these dye salts, however, involves an additional processing step in manufacturing the toner powders. Moreover, many of the proposed dye salts exhibit a low thermal stability, as a result of which their use in toner powders is not particularly attractive because these powders are usually prepared from a resin melt at from 90° to 130° C and are often employed in developing apparatus in which the temperature may rise to 45° C or higher.

According to the present invention, a toner powder is provided which contains the desired polarity controlling and/or coloring organic dye in a dissolved state. The individual particles of this powder comprise an epoxy resin, an organic dye that in itself is insoluble, or substantially so, in the epoxy resin and a substance that promotes the dissolution of the dye in the epoxy resin, this solubilizing substance being selected from the group consisting of complete esters and alkyl and aryl amides of ortho- and meta-phthalic acid, carbonic acid, phosphoric acid, benzoic acid and benzenesulphonic acids and condensation products of formaldehyde with alkyl and aryl amides of benzenesulphonic acids.

An organic dye is in itself insoluble in epoxy resin, according to the meaning used herein, if less than 1% by weight of the organic dye dissolves within 30 minutes in a melt of the epoxy resin at 120° C. The term epoxy resin as used herein means the thermoplastic non-cross-linked condensation products of a polyphenol, in particular a bisphenol, with epichlorohydrin. So, besides the low molecular weight condensation products of such compounds, which are generally designated as epoxy resin, the term epoxy resin as used herein also includes the thermoplastic, high molecular weight condensation products, often referred to as phenoxy resin, as prepared by the condensation of epichlorohydrin with a molar excess of polyphenol.

Surprisingly it has been found that organic dyes which in themselves are insoluble in epoxy resin can be dissolved therein to an extent of from 5 to 10% by weight, or even more, with the aid of the previously specified solubilizing substances. This effect appears to be peculiar to the use of epoxy resin, as the specified substances proved to be ineffective in combination with other thermoplastic resins frequently used in toner powders such as, for example, polystyrene and copolymers of styrene with an acrylate or methacrylate.

To obtain homogeneous toner powders, the dye solubilizing substances used according to the invention are to be completely miscible with the epoxy resin, at least in the quantity in which they are used. The content of such substances in the toner powders can be as high as is fully miscible with the epoxy resin. Preferably, however, the content of dye solubilizing substance does not exceed 15% by weight. For most cases, contents of up to 7% by weight are quite sufficient to dissolve fully in the epoxy resin the amounts of organic dye, of approximately 2–5% by weight, usually employed in powder toners. Some of the specified substances for promoting the dissolution of the dye have appeared to be already effective at contents as little as approximately 1% by weight.

Examples of dye solubilizing substances useful according to the invention which are completely miscible with epoxy resin in an amount of 15% by weight, or more, include diphenyl-ortho-phthalate, diphenyl-meta-phthalate, dicyclohexyl-ortho-phthalate, dicyclohexyl-meta-phthalate, diethyl-ortho-phthalate, dimethyl-meta-phthalate, dibutyl-meta-phthalate, triphenyl phosphate, tricresyl phosphate, diphenyl-carbonate, phenyl benzoate, phenyl-p-toluenesulphonate, N,N'-diethyl-N,N'-diphenylurea, N-cyclohexyl p-toluenesulphonamide, N-methyl-N-phenyl p-toluenesulphonamide, and N,N-diethyl p-toluenesulphonamide, as well as the condensation products of the said sulphonamides with formaldehyde. The alkyl, cycloalkyl and aryl groups in the specified esters and amides may carry further substituents when desired.

The substances in the previously defined group which have a melting point between 50° and 120° C are preferred for use according to the invention, because under the practical conditions of use of toner powders, in which the powders may be subjected in the developing apparatus to temperatures of 45° C or higher, such substances migrate to a lesser extent than substances having a melting point below 50° C. Substances melting above 120° C are less attractive, because undesirably high temperatures are required for the preparation of the toner powders from a melt of these substances.

If an epoxy resin carrying reactive terminal epoxide groups is used in a toner powder according to the invention, then, in order to prevent cross-linking of the epoxy resin, the dye solubilizing substance to be selected from the previously defined group is one which contains at most one and preferably not any group that is reactive to the epoxide group under the conditions of manufacture and/or use of the toner powder. For example, in combination with epoxy resins containing reactive epoxide groups, the solubilizing substances to be used will be those which carry in their molecule no reactive, free amino group and not more than one reactive —OH, —SH or secondary amino group.

On the other hand, if reactive epoxide groups are present in the epoxy resin they can be made inactive in a conventional manner, without cross-linking the resin. This can be accomplished, for example, by reacting them with a monofunctional reagent such as a monobasic carboxylic acid, or with a monovalent alcohol, thiol or phenolic compound, or with a strong inorganic acid such as hydrochloric acid. In the use of such inactivated epoxy resins, of course, the dye solubilizing substances to be used can be any of those of the previously defined group, whether or not they carry more than one group reactive to an epoxide group.

Highly advantageous substances among those defined for promoting the dissolution of the dye in the epoxy resin are the bis-esters of the phthalic acids referred to above, as well as benzene sulphonamides the amino group of which has been substituted by one or two alkyl, cycloalkyl or aryl groups, or by an alkyl or cycloalkyl and an aryl group. Particularly suitable as substances of this class are: diphenyl-ortho-phthalate, diphenyl-meta-phthalate, dimethyl-ortho-phthalate, dimethyl-meta-phthalate, N-methyl-N-cyclohexyl p-toluenesulphonamide, N-methyl-N-phenyl p-toluenesulphonamide and N-cyclohexyl p-toluenesulphonamide.

The common organic dyes frequently used in toner powders can be dissolved in epoxy resin according to the present invention. When the epoxy resins to be used carry terminal epoxide groups the organic dye is of course selected so that it will not cause cross-linking of the epoxy resin under the conditions of manufacture and/or use of the toner powder. In the use of basic organic dyes, the solubilizing substances are most effective when the dyes are used as free bases rather than as salts. It is also practicable, however, to select the solubilizing substance so that it will effect the dissolution of salts of the basic dyes, for example the chlorides. Examples of the dyes that can be dissolved in epoxy resin according to the invention are: nigrosine (C.I. 50420), Janus Blue (C.I. 12211), Nile Blue (C.I. 51180), Pyronine G (C.I. 45005), Crystal Violet (C.I. 42555), Safranine T (C.I. 50240), Neutral Red (C.I. 50040), Astrazon Gelb 5G (C.I. 48065), Astrazon Orange G (C.I. 48035), Methyl Violet (C.I. 42535) and Methylene Blue (C.I. 52015).

Mixtures of organic dyes can, of course, also be used in the toner powders according to the invention. If desired, the organic dyes can be purified prior to being applied in the toner powders. In addition to dyes, the toner powders may, of course, also contain one or more pigments, for example carbon black.

Besides organic dyes, other substances which in themselves are insoluble in epoxy resin, such as, for example, polarity control agents that are not dyes, can often be dissolved in epoxy resin by use of the solubilizing substances employed according to the invention.

The epoxy resin to be used in the toner powders according to the invention can be selected from the epoxy resins known to be suitable for the manufacture of toner powders. Generally, these resins are low molecular weight products, preferably possessing a softening point between 80° and 120° C, and are derived from a bisphenol, such as bisphenol A, and epichlorohydrin. On the other hand, high molecular weight epoxy resins possessing a softening point above 120° C can also be used. Their softening point is lowered by the addition of the substance promoting the dissolution of the dye, so that, when this substance and/or its quantity used is properly selected, it is still possible to obtain toner powders that are fusible at an acceptable level of temperature below the scorch temperature of paper.

The preparation of toner powders according to the invention can be effected simply by dissolving the organic dye to the desired concentration in the solubilizing substance(s) or in a melt thereof, mixing this dye solution with a melt of the epoxy resin, homogenizing the molten mixture, then solidifying it by cooling and, finally, grinding the solid mass into particles of the desired size. The toner powder can also be prepared by adding organic dye to a melt of the epoxy resin and the solubilizing substance(s), mixing the melt until the dye has been completely dissolved, cooling down the solution, and grinding the solid mass to particles of the desired size.

According to another method of manufacture, the dye is dissolved in a melt of the solubilizing substance(s), after which the melt is solidified by cooling down, and the solid mass is ground to a fine powder which is then mixed with epoxy resin powder, for example in a powder mixer. A homogeneous melt is then prepared from the powder mixture thus obtained, for example in an extruder, and this melt is solidified and then ground into a toner powder as described hereinbefore.

The practice of the invention will be further evident from the following illustrative examples.

EXAMPLE 1

In a laboratory kneading machine,
900 g of epoxy resin (Epikote 1007) were mixed at a temperature between 100° and 110° C with a solution of
25 g of nigrosine base in
50 g of molten diphenyl-ortho-phthalate.
After a mixing time of approximately 20 minutes, during which a homogeneous melt was obtained,
25 g of carbon black
were added, and the mixing operation was continued for approximately 30 minutes. The melt was then removed from the kneading machine and cooled down to a solid mass. Finally, the solid mass was ground to particles having sizes between 5 and 30 micrometers.

A two-component powder developer was prepared by mixing in a powder mixer
40 g of the black toner powder thus obtained with
960 g of iron particles having sizes between 40 and 300 micrometers.

This powder developer, in which the toner powder acquired a positive charge, was used in an electrophotographic copier of the type described in United States patent Copies of very good quality were obtained.

When the preparation of the toner was attempted with no diphenyl-ortho-phthalate present, only a very minor amount of the nigrosine base dissolved in the epoxy resin.

EXAMPLE 2

Toner powders A through F, containing the ingredients in proportions by weight as specified hereafter, were prepared in the way described in Example 1:

A.

6% of N,N'-diethyl-N,N'-diphenylurea,
3% of nigrosine base,
4% of carbon black and
87% of epoxy resin (Epikote 1007).

B.

10% of N-cyclohexyl p-toluenesulphonamide,
2% of nigrosine hydrochloride,
4% of carbon black and
84% of epoxy resin (EKR 2003).

C.

4% of the condensation product of an aryl sulphonamide with formaldehyde (Santolite MHP),
2% of nigrosine base,
5% of carbon black and
89% of epoxy resin (Loopox 100).

D.

5% of triphenyl phosphate,
2.5% of nigrosine base,
3% of carbon black and
89.5% of epoxy resin (Epikote 1006).

E.

Like D, but now with 5% by weight of diphenylmethaphthalate instead of 5% by weight of triphenyl phosphate.

F.

Like D, but now with 5% by weight of dicyclohexylortho-phthalate instead of 5% by weight of triphenyl phosphate.

With these toner powders, all of which contained the dye in a dissolved state, two-component powder developers containing 4% by weight of toner powder and 96% by weight of iron carrier particles were prepared. These powder developers were employed for magnetic brush development of electrostatic images formed in a photoconductive zinc oxide-binder layer, and the powder images were fixed by heating.

When no solubilizing substance according to the invention was used in the above formula, only a minor amount of the nigrosine base dissolved in the epoxy resin.

EXAMPLE 3

Toner powders G through O, containing the ingredients in proportions by weight as specified hereafter, were prepared in the way described in Example 1:

G.

6% of diphenyl carbonate,
2% of nigrosine base,
4% of carbon black and
88% of epoxy resin (Epikote 1006).

H.

7% of N-cyclohexyl p-toluenesulphonamide,
5% of Astrazone Yellow 5G and
88% of epoxy resin (Epikote 1006).

I.

Like H, but now with 5% of Astrazone Orange G instead of 5% of Astrazone Yellow 5G.

J.

Like H, but now with 7% of dimethyl-ortho-phthalate instead of 7% of N-cyclohexyl p-toluene-sulphonamide.

K.

10% of N-methyl-N-phenyl p-toluenesulphonamide,
6% of Methylene Blue and
84% of epoxy resin (Epikote 1006).

L.

Like K, but now with 6% of Nile Blue instead of 6% of Methylene Blue.

M.

12% of dimethyl-meta-phthalate,
3% of nigrosine base,
2% of carbon black and
83% of high-molecular weight epoxy resin (Rutapox 07-17).

N.

6% of N,N-diethyl p-toluenesulphonamide,
3% of nigrosine hydrochloride,
2% of carbon black and
89% of high-molecular weight epoxy resin (Rutapox 07-17).

O.

5% of phenyl p-toluenesulphonate,
2% of nigrosine base,
3% of carbon black and
90% of epoxy resin (Epikote 1006).

In all cases, the organic dye dissolved completely in the epoxy resin whereas, without using a substance promoting the dissolution of the dye, the dye did not dissolve in the epoxy resin, or dissolved only sparingly.

I claim:

1. Toner powder for the development of electrostatic images, the individual particles of which comprise thermoplastic resin consisting essentially of epoxy resin and organic dye that in itself is insoluble in the epoxy resin, characterized in that said particles contain in an amount enhancing dissolution of said dye in said resin at least one substance selected from the group consisting of complete esters and alkyl and aryl amides of o- and m-phthalic acid, carbonic acid, phosphoric acid, benzoic acid and benzenesulphonic acids and condensation products of formaldehyde with alkyl, cycloalkyl and aryl amides of benzenesulphonic acids.

2. Toner powder according to claim 1, said particles containing up to 15% by weight of said at least one substance.

3. Toner powder according to claim 1, said at least one substance having a melting point between 50° and 120° C.

4. Toner powder according to claim 1, said at least one substance comprising a bis-ester of ortho- or metaphthalic acid.

5. Toner powder according to claim 1, said at least one substance being diphenyl-ortho-phthalate or diphenyl-metaphthalate.

6. Toner powder according to claim 1, said at least one substance being dimethyl-ortho-phthalate or dimethyl-metaphthalate.

7. Toner powder according to claim 1, said at least one substance being a benzenesulphonamide the amino group of which has been substituted by one or two alkyl, cycloalkyl or aryl groups or by an alkyl or cycloalkyl and an aryl group.

8. Toner powder for the development of electrostatic images, the individual particles of which consist essentially of thermoplastic resin and coloring material and contain organic dye as a coloring material and/or for polarity control, characterized in that said resin consists substantially entirely of epoxy resin and said particles contain about 2 to 5% by weight of dye that in itself is substantially insoluble in the epoxy resin yet is dissolved therein by the presence therein of a substance completely miscible with said resin and having a melting point between 50° and 120° C and selected from the group consisting of bis-esters of o- and m-phthalic acids and alkyl, cycloalkyl and aryl amides of benzene sulfonic acids.

9. Toner powder according to claim 8, said substance being selected from the group consisting of diphenyl-ortho-phthalate, diphenyl-meta-phthalate, dimethyl-ortho-phthalate, dimethyl-meta-phthalate, N-methyl-N-cyclohexyl p-toluenesulfonamide, N-methyl-N-phenyl p-toluenesulfonamide and N-cyclohexyl p-toluenesulfonamide.

* * * * *